United States Patent [19]

Motomura

[11] Patent Number: 4,789,020

[45] Date of Patent: Dec. 6, 1988

[54] APPARATUS FOR SUPPLYING MOLTEN METAL TO DIE CAST MACHINES

[75] Inventor: Noriyuki Motomura, Zama, Japan

[73] Assignee: Toshiba Kikai Kabushiki Kaisha, Tokyo, Japan

[21] Appl. No.: 21,509

[22] Filed: Mar. 4, 1987

[30] Foreign Application Priority Data

Mar. 5, 1986 [JP] Japan ..... 47717
Mar. 6, 1986 [JP] Japan ..... 49421

[51] Int. Cl.[4] ..... B22D 27/02; B22D 17/08

[52] U.S. Cl. ..... 164/147.1; 164/500; 164/312

[58] Field of Search ..... 164/147.1, 500, 513, 164/312; 266/237; 222/594

[56] References Cited

U.S. PATENT DOCUMENTS 2,224,982 12/1940 Morin ..... 164/500
4,556,098 12/1985 Hintermann et al. ..... 164/316

FOREIGN PATENT DOCUMENTS 2514565 10/1976 Fed. Rep. of Germany ..... 164/54
45-11125 4/1970 Japan ..... 164/312
48-13214 4/1973 Japan ..... 164/147.1

*Primary Examiner*—Kuang Y. Lin
*Attorney, Agent, or Firm*—Cushman, Darby & Cushman

[57] ABSTRACT

In apparatus for supplying molten metal to an injection sleeve of a die cast machine from a pot containing the molten metal through a metal supply pipe, an electromagnetic pump is provided including an electromagnetic coil surrounding the molten metal supply pipe and a magnetic core inserted into the molten metal supply pipe from inside of the pot. The inner surface of the molten metal supply pipe is coated with a ceramic layer formed by centrifugal thermit method.

3 Claims, 3 Drawing Sheets

APPARATUS FOR SUPPLYING MOLTEN METAL TO DIE CAST MACHINES

BACKGROUND OF THE INVENTION

This invention relates to apparatus for supplying molten metal to a die cast machine, and more particularly apparatus for supplying molten metal by utilizing an electromagnetic pump.

An electromagnetic pump has been used for supplying molten metal to the injection sleeve of a die cast machine from a furnace constructed to maintain the temperature of the molten metal. Such prior art apparatus will firstly be described with reference to FIGS. 3 and 4.

In these figures, a furnace for maintaining the temperature of molten metal is designated by a reference numeral 1 and a pot 3 containing the molten metal 2 is disposed in the furnace 1 with a suitable spacing therebetween.

A molten metal supply pipe 4 is connected to the side wall of the pot 3 so as to connect an injection sleeve 45 to the pot 3.

The molten metal supply pipe 4 is constituted by a duct 4*a* extending through the side wall of the furnace 1 and opens into the pot 3, and a molten metal supply pipe 4*b*. A magnetic core 6 is inserted into duct 4*a* through the outer end thereof. A packing member 7 is interposed between the enlarged head of core 6 and the outer end of duct 4*a* so as to prevent leakage of the molten metal.

An inverted L shaped molten metal supply pipe 4*b* vertically extends from the outer end of duct 4*a* and the upper end of pipe 4*b* is connected to an injection sleeve 45.

An electromagnetic coil 5 is mounted about the duct 4*a*, the electromagnetic coil 5 constituting an electromagnetic pump together with the magnetic core 6. The electromagnetic pump operates in a manner well known in the art for pumping the molten metal in the pot 3 to the injection sleeve 45.

With the prior art molten metal supply apparatus of the type described above, in order to exchange the magnetic core 6, after discharging the molten metal 2 in pot 3 it is necessary to withdraw the core 6 from the duct 4*a*. This not only requires a certain time for exchanging the core but also requires to provide an operating space of a volume necessary to withdraw the core. At the same time it is also necessary to exchange the packing member 7.

On the other hand, in an electromagnetic pump utilized to pump molten metal, the inner surface of pipe 4*a* is corroded by the molten metal so that in the prior art design the pipe 4*a* was made of such ceramics as silicon nitride or alumina which is nonmagnetic and resistant to molten metal.

However, a pipe or duct made of ceramic is liable to be broken by a heat shock or a mechanical shock. To obviate this problem it has been considered to apply the ceramic to the inner surface of the duct by flame coating method or melt coating method. However such method is difficult where the inner diameter of the duct is small.

SUMMARY OF THE INVENTION

Accordingly it is object of this invention to provide improved apparatus for supplying molten metal to a die cast machine capable of exchanging in a short time, the magnetic core of an electromagnetic pump without the necessity of discharging the molten metal in the pot.

Another object of this invention is to provide improved apparatus for supplying molten metal to a die cast machine which is not required to use a packing member between a duct for conveying the molten metal and the magnetic core of the electromagnetic pump.

A further object of this invention is to provide a novel electromagnetic pump utilized to convey molten metal and having a durable duct for conveying the molten metal.

DESCRIPTION OF THE PREFERRED EMBODIMENTS

Figure 1:
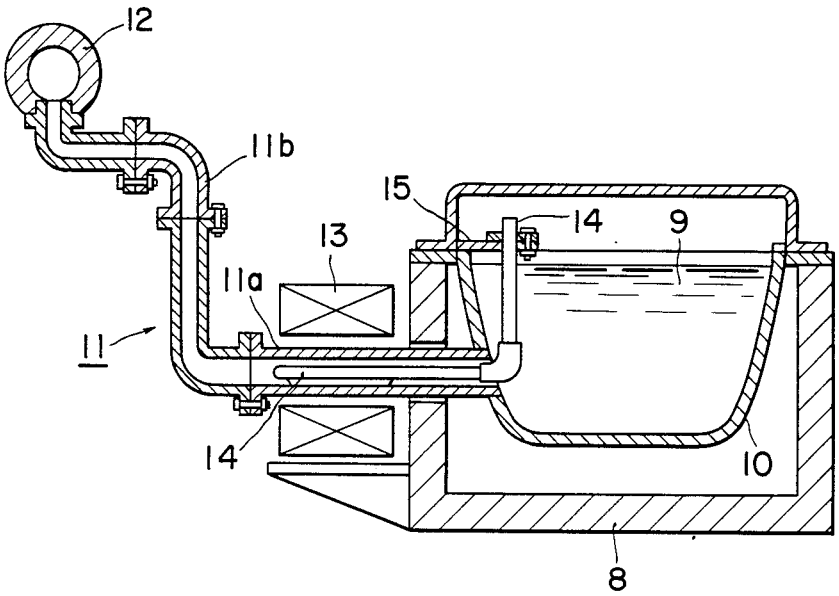
FIG. 1 is a vertical sectional view showing one embodiment of the apparatus for supplying molten metal to a die cast machine according to this invention.
Figure 2:
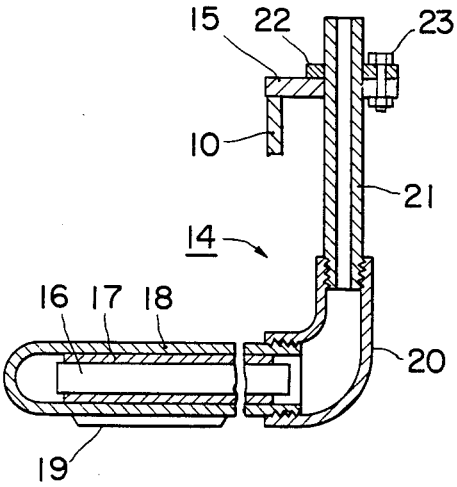
FIG. 2 is a vertical sectional view showing the detail of the magnet core of the electromagnetic pump shown in FIG. 1.
Figure 3:
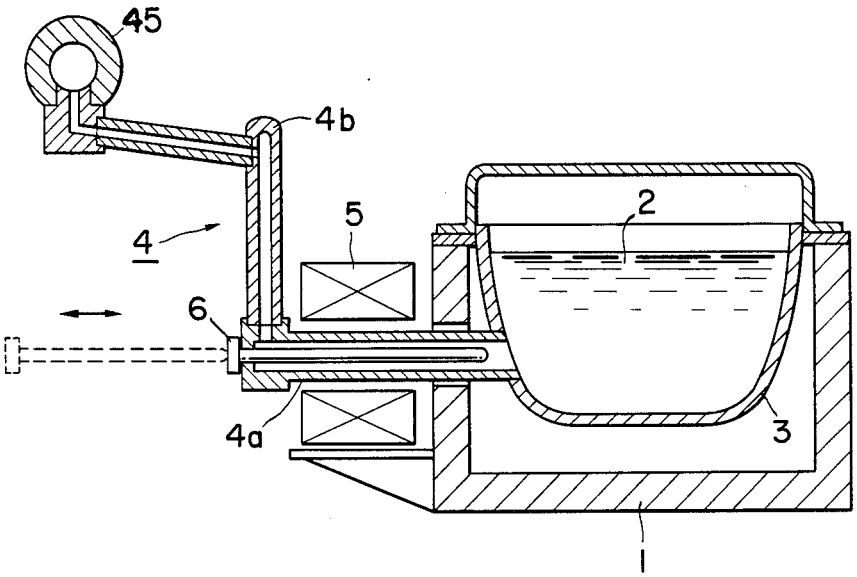
FIG. 3 PRIOR ART
FIG. 3 is a vertical sectional view showing prior art apparatus.
Figure 4:
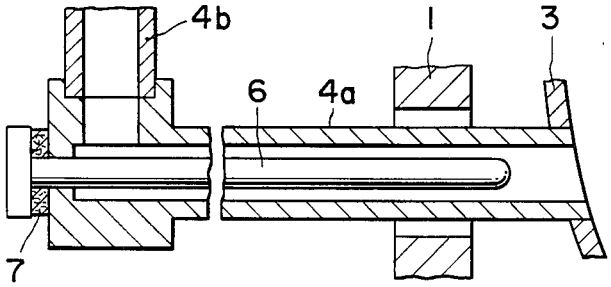
FIG. 4 PRIOR ART
FIG. 4 is a longitudinal sectional view showing a pipe for conveying molten metal and the magnetic core of an electromagnetic pump.

Referring now to FIGS. 1 and 2 the apparatus for supplying molten metal to a die casting machine embodying the invention will be described. In these figures, a pot 10 containing molten metal is disposed in a furnace 8 for maintaining the temperature of the molten metal with a suitable spacing between the pot and the furnace.

A molten metal supply pipe 11 is connected to the side wall of the pot 10 so as to communicate the interior of the pot 10 with the injection sleeve 12.

The molten metal supply pipe 11 is constituted by a duct 11*a* extending through the side wall of furnace 8 and opening into pot 10, and a molten metal supply pipe 11*b* connected to the duct 11*a*. The magnetic core 14 of the electromagnetic pump is inserted into the duct 11*a* from inside of the pot 10.

As shown, the magnetic core 14 takes the form of an inverted L. One leg of the core 14 is inserted into duct 11*a* and the other leg is secured to the upper portion of pot 10 by a holding fixture 15.

The outer end of duct 11*a* is connected to a upright molten metal supply pipe 11*b* which is connected to the injection sleeve 12.

An electromagnetic coil 13 is mounted to surround duct 11*a*, the coil 13 constituting the electromagnetic pump together with the magnetic core 14. Thus, the molten metal is conveyed to the injection sleeve 12 from pot 10 by the electromagnetic pump.

The detail of the magnetic core 14 is shown in FIG. 2. As shown, a magnetic rod 16 is covered by a sheath 17 made of heat insulating material. The rod 16 and the sheath 7 of the heat insulating material are inserted into a pipe 18 having a hemispherical end. A spacer 19 is welded to the lower surface of the pipe 18 for defining an air gap between the inner wall of duct 11*a* and the outer wall of pipe 18.

One end of the pipe 18 is threaded into one end of an elbow 20, the other end thereof being connected to the lower end of a vertical pipe 21. A fixture 22 is mounted on the upper end of pipe 21. The fixture 22 is bolted to a slotted holding fixture 15 welded to the upper edge of pot 10.

A sheath heater or the like electric heater (not shown) is provided to surround the duct and the molten metal supply pipe for maintaining the temperature of the molten metal.

With the molten metal supply apparatus described above, as the magnetic core of the electromagnetic pump can readily be exchanged by merely removing the bolts 23, utilized to secure the fixture 22, and moving the L-shaped magnetic core to the right. Consequently it is not necessary to discharge the molten metal in the pot. Moreover such exchange of the magnetic core can be made in a short time and without providing an operating space. Further, no packing member is necessary between the duct and the magnetic core.

Figure 5:
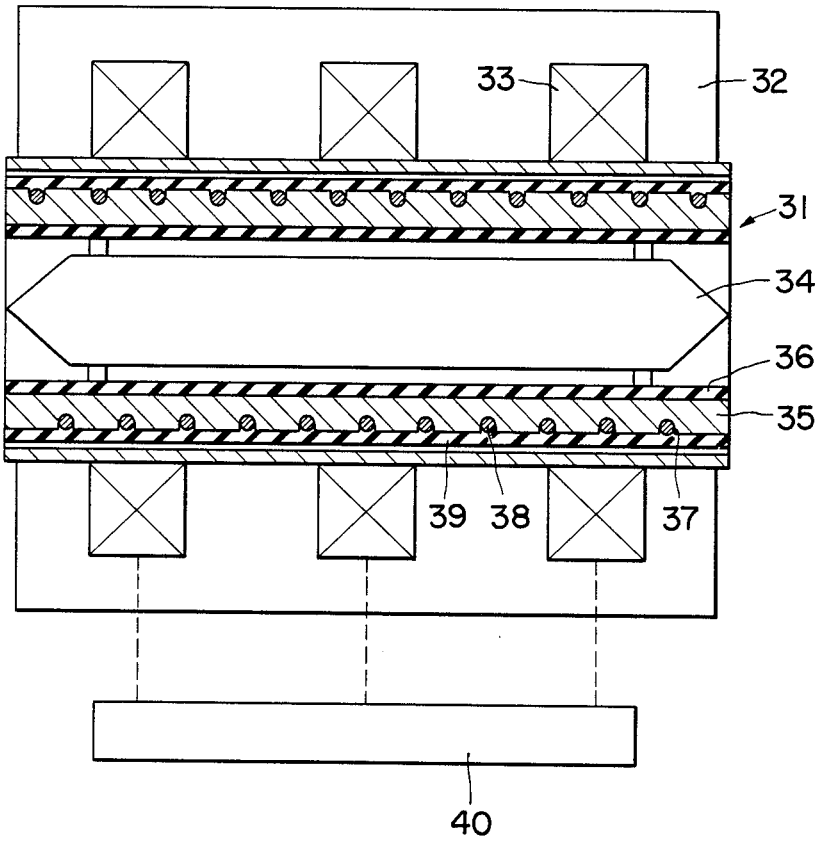
FIG. 5 is a vertical sectional view showing an improved electromagnetic pump embodying the invention.

FIG. 5 illustrates an improved electromagnetic pump according to this invention. As shown the pump comprises a duct 31, a magnetic yoke 32 surrounding the duct, a three phase induction coil 33 energized by a three phase source 40 and contained in the slots of the magnetic yoke 32 and a magnetic core 34 concentrically contained in the duct 31. A gap is provided between the core 34 and duct 31 for defining a passage for the molten metal.

The duct 31 comprises a nonmagnetic metal pipe 35 made of stainless steel or manganese steel, a ceramic layer 36 of alumina, for example, formed on the inner surface of the metal pipe 35, a sheath heater 38 contained in a helical groove 37 formed on the outer surface of the duct 31 and a layer of heat insulating material 39 covering the sheath heater.

According to this invention the ceramic layer 36 is formed by well known centrifugal thermit method. More particularly, a mixture of powders of iron oxide, aluminum and ceramic (alumina) is prepared and the powders of the iron oxide and aluminum are ignited to produce a high temperature which is used to sinter the ceramic powder onto the inner surface of the metal pipe 35 thereby forming ceramic layer 36. At this time, the metal pipe 35 is rotated to densely sinter the ceramic powder on the inner surface of metal pipe 35 by the centrifugal force.

With this construction, the metal pipe 35 prevents rupture caused by heat shock or the like while the ceramic layer 36 provides excellent corrosion resistant property against molten metal. Since the duct 31 is made up of a metal pipe 35 having a high heat conductivity the temperature of the molten metal contained in the metal pipe 35 tends to decrease. But such tendency can be prevented by heat generating wire 38 wound about the metal pipe. Since the ceramic layer 36 is formed by centrifugal thermit method, even when the inner diameter of the metal pipe 35 is small, the ceramic layer 36 can be formed readily. Moreover the ceramic layer improves the durability, that is life of the electromagnetic pump.

What is claimed is:

1. Apparatus for supplying molten metal to a die cast machine comprising:

a furnace having a pot for containing molten metal;

an injection sleeve of the die cast machine;

a molten metal supply pipe interconnecting said pot and said injection sleeve;

an electromagnetic coil surrounding said molten metal supply pipe; and a magnetic core inserted into said molten metal supply pipe from inside of said pot, said magnetic core and said electromagnetic coil cooperating to constitute an electromagnetic pump, wherein:

said magnetic core comprises a vertical pipe removably mounted on said pot, and a hollow pipe containing a magnetic rod, one end of said hollow pipe being connected to a lower end of said vertical pipe while the other end of said hollow pipe being closed.

2. Apparatus for supplying molten metal to a die cast machine comprising:

a furnace having a pot for containing molten metal;

an injection sleeve of the die cast machine;

a molten metal supply pipe interconnecting said pot and said injection sleeve;

an electromagnetic coil surrounding said molten metal supply pipe; and a magnetic core insertable into said molten metal supply pipe from inside of said pot, said magnetic core and said electromagnetic coil cooperating to constitute an electromagnetic pump, said supply pipe comprising a duct adapted to convey molten metal, said magnetic core being contained in said duct with a gap therebetween, said gap being utilized as a passage of said molten metal, said duct being constituted by a non-magnetic metal pipe and a ceramic layer formed on an inner peripheral surface of said metal pipe by centrifugal thermit method, wherein said magnetic core comprises a vertical pipe removably mounted on said pot, and a hollow pipe containing a magnetic rod, one end of said hollow pipe being connected to a lower end of said vertical pipe with the other end of said hollow pipe being closed.

3. Apparatus as in claim 2, further comprising a heat generating wire wound about said duct.

* * * * *